US005662425A

United States Patent [19]

Mitsuya

[11] Patent Number: 5,662,425

[45] Date of Patent: Sep. 2, 1997

[54] STICK-SHAPED MATERIAL PROPELLING CONTAINER

[75] Inventor: Yoshihide Mitsuya, Kawagoe, Japan

[73] Assignee: Kotobuki & Co., Ltd., Kyoto, Japan

[21] Appl. No.: 693,013

[22] Filed: Aug. 6, 1996

Related U.S. Application Data

[60] Continuation of Ser. No. 271,200, Jul. 7, 1994, abandoned, which is a division of Ser. No. 137,616, Oct. 15, 1993, abandoned.

[51] Int. Cl.[6] ..... A45D 40/04; B43K 25/00

[52] U.S. Cl. ..... 401/68; 401/52; 401/53

[58] Field of Search ..... 401/49, 52, 53, 401/55, 68, 75, 77, 78, 86, 87

[56] References Cited

U.S. PATENT DOCUMENTS

| | | | |
|---|---|---|---|
| 4,904,101 | 2/1990 | Petterson | 401/52 |
| 5,018,891 | 5/1991 | Kageyama et al. | 401/52 |
| 5,022,774 | 6/1991 | Kageyama et al. | 401/52 |

FOREIGN PATENT DOCUMENTS

| | | | |
|---|---|---|---|
| 2-28077 | 7/1970 | Japan | 401/52 |
| 57-132598 | 8/1982 | Japan | 401/52 |
| 3397 | 5/1986 | Japan | 401/52 |

*Primary Examiner*—Robert A. Hafer
*Assistant Examiner*—D. Neal Muir
*Attorney, Agent, or Firm*—David O'Reilly

[57] ABSTRACT

A stick-shaped material propelling container is comprised of a tubular body provided with a spiral groove in the inside thereof, a guide sleeve inserted into the tubular body that is not movable in an axial direction, but rotatable relative to the tubular body, and which is provided with guide grooves extending in the axial direction. A holder for holding stick-shaped material, is provided with projections to engage the spiral groove, so that a stick-shaped material held in the holder can be selectively extended from or retracted into the stick-shaped material propelling container. The stick-shaped material propelling container further includes a slit formed in the axial direction through a side wall portion of the holder where there are no projections.

3 Claims, 5 Drawing Sheets

STICK-SHAPED MATERIAL PROPELLING CONTAINER

This is a continuation of application Ser. No. 08/271,200 filed on Jul. 7, 1994, now abandoned, which is a division of Ser. No. 08/137,616 filed Oct. 15, 1993, now abandoned.

BACKGROUND OF THE INVENTION

1. Field of the Invention

The present invention relates to a stick-shaped material propelling container in which a stick-shaped material such as a stick-shaped eraser, a lip stick, a retouching stick, a pencil lead, a fluorescent lead, stick-shaped adhesive, and pastel and the like can be selectively extended from and retracted into the stick-shaped material propelling container by a turning operation, and in particular to a stick-shaped material propelling container which can be simply formed and can be easily and quickly assembled.

2. Background Information

One example of a stick-shaped material propelling container wherein a stick-shaped material can be selectively extended from and retracted into the container, is a stick-shaped material propelling container described in utility model application laid open 19093 of 1991 (Heisei 3), corresponding to U.S. Pat. No. 5,193,927, assigned to the same assignee as this application.

In the prior example described in utility model application laid open 19093 of 1991 (Heisei 3), short slits are provided on a holder for holding a stick-shaped material in order to make a projection of a holder easily engage with a guide groove on a guide sleeve of the container. To assemble the stick-shaped material propelling container, the holder projection engages the guide groove by inserting the holder into the guide sleeve from a head portion of the guide sleeve while the holder is bent inward.

However, bending the holder is not sufficient to allow the holder to be easily inserted into the guide sleeve. Particularly in case of a holder with a small diameter, insertion of the holder into the guide sleeve is very difficult.

SUMMARY OF INVENTION

It is an object of the present invention to provide a stick-shaped material propelling container in which a holder can bend sufficiently to allow assembly thereof to be carried out easily and quickly.

In order to achieve the object, a stick-shaped material propelling container according to the present invention comprises a tubular body provided with a spiral groove in an inside thereof, and a guide sleeve inserted into the tubular body. The guide sleeve is not movable in an axial direction, but is rotatable with respect to the tubular body, and has a guide groove extending in the axial direction. A holder for holding stick-shaped material, is provided with projections to engage the spiral groove, so that a stick-shaped material held in the holder is selectively extended from or retracted into the stick-shaped material propelling container. The stick-shaped material propelling container further comprises a slit formed in the axial direction through a side wall portion of the holder where there are no projections.

In the present invention, a ring can be provided to cover the top of the guide sleeve.

In the present invention, since a slit extends in the axial direction from a front end to a rear end of the holder and is formed in a side wall portion of the holder where there are no projections, it is possible for the holder to bend sufficiently. As the holder has flexibility over the axial length thereof, insertion of the holder into the guide groove can be easily made. Accordingly, the stick-shaped material propelling container can be easily and quickly assembled.

After assembling the stick-shaped material propelling container, the holder also has sufficient flexibility. Therefore, even in use, a forcible turning of the tubular body with the holder positioned at either end of the spiral groove, the holder can bend inward and over the ridge between spiral grooves so that the holder can rotate idly at the ends. Accordingly breaking of the spiral groove of the guide sleeve or the projection of the holder can be surely prevented.

The holder can be formed in a mold using a pin located at a position corresponding to the position of the slit in the holder. It can completed in a shorter time at lower cost.

Further, when a ring is mounted on the guide sleeve to cover the head end, the ring can easily pass over the holder when assembling.

Other objects and advantages of the invention will become more apparent from the following portion of this specification and from the accompanying drawings.

DETAILED DESCRIPTION OF THE INVENTION

An embodiment of the present invention is explained as follows with reference to FIGS. 1 to 5.

Figure 1:
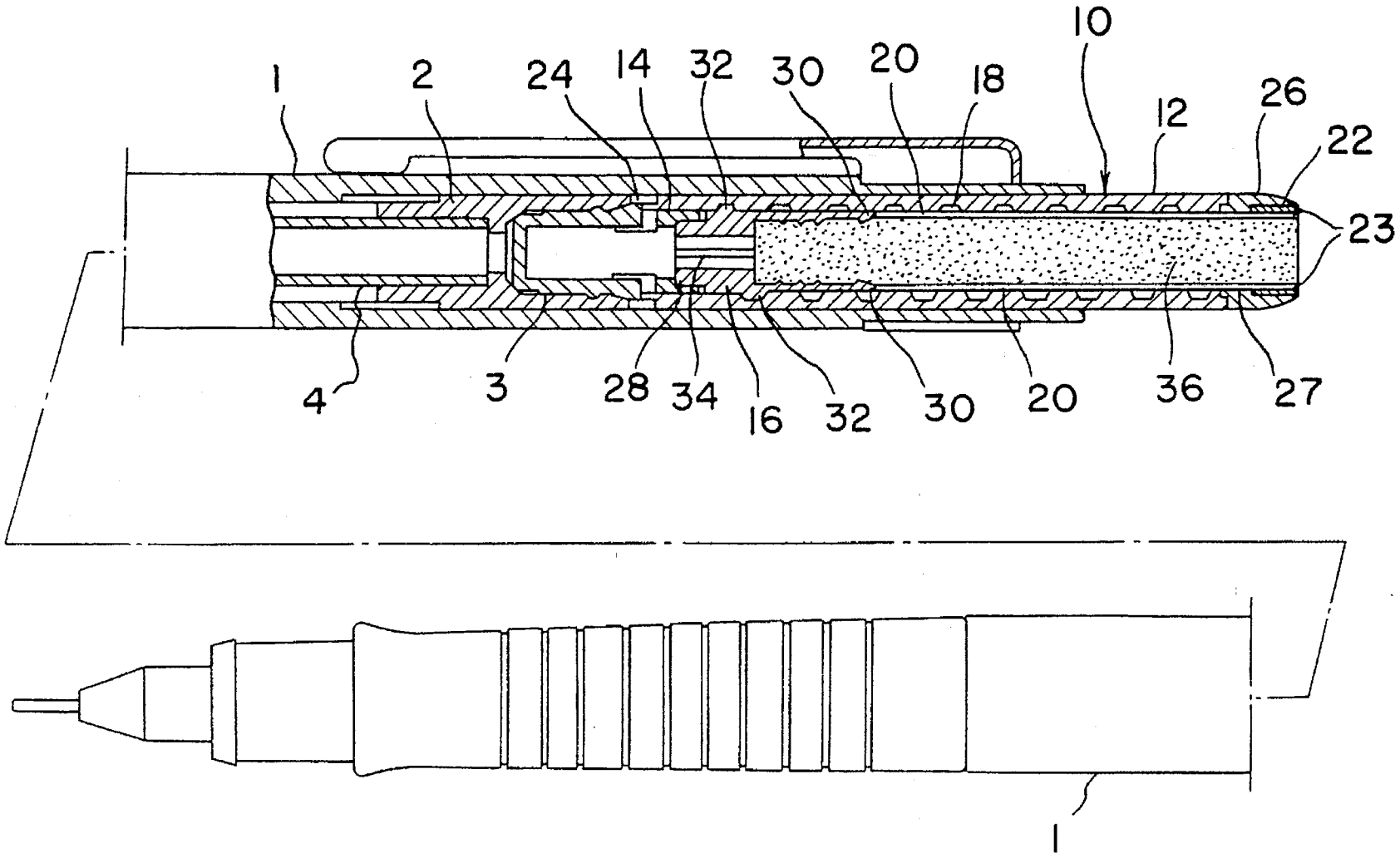
FIG. 1 is a vertical section of a stick-shaped material propelling container according to the present invention installed in a mechanical pencil.
Figure 2A:
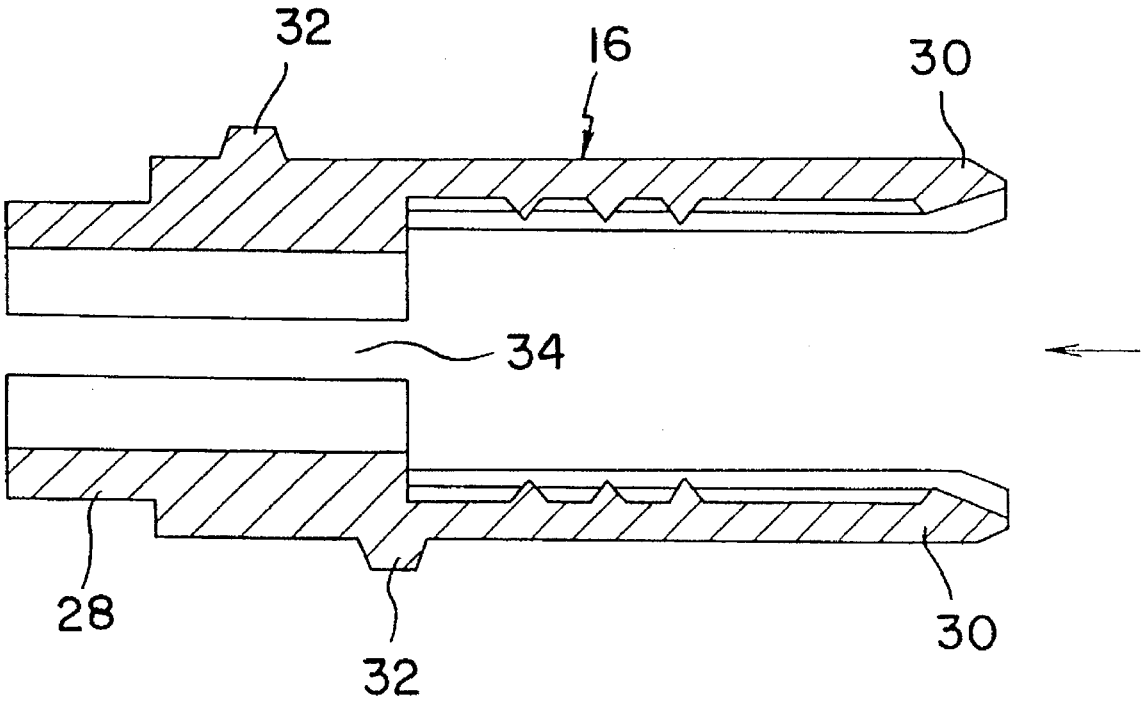
FIGS. 2(A) and (B) are enlarged views of a holder for the stick-shaped material propelling container shown in FIG. 1, FIG. 2(A) being a vertical section, and FIG. 2(B) being a view taken in the direction of the arrow shown in FIG. 2(A), respectively.
Figure 2B:
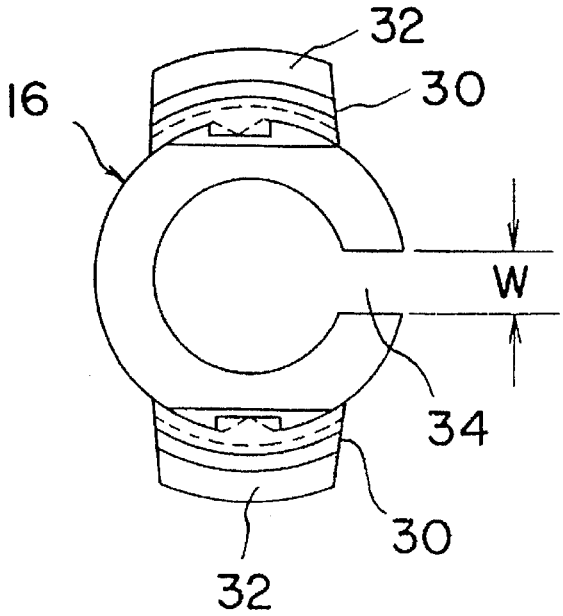

FIG. 1 is a vertical section of an embodiment of a stick-shaped material propelling container, and FIGS. 2(A) and (B) are enlarged sections of a holder for the stick-shaped material propelling container.

Stick-shaped material propelling container 10 according to the embodiment is installed in, for example, a mechanical pencil by insertion into outer sleeve 1 of the mechanical pencil.

Stick-shaped material propelling container 10 is comprised of tubular body 12 provided with inner spiral groove 18, with guide sleeve 14 inserted in tubular body 12, and holder 16 inserted in guide sleeve 14.

Figure 3:
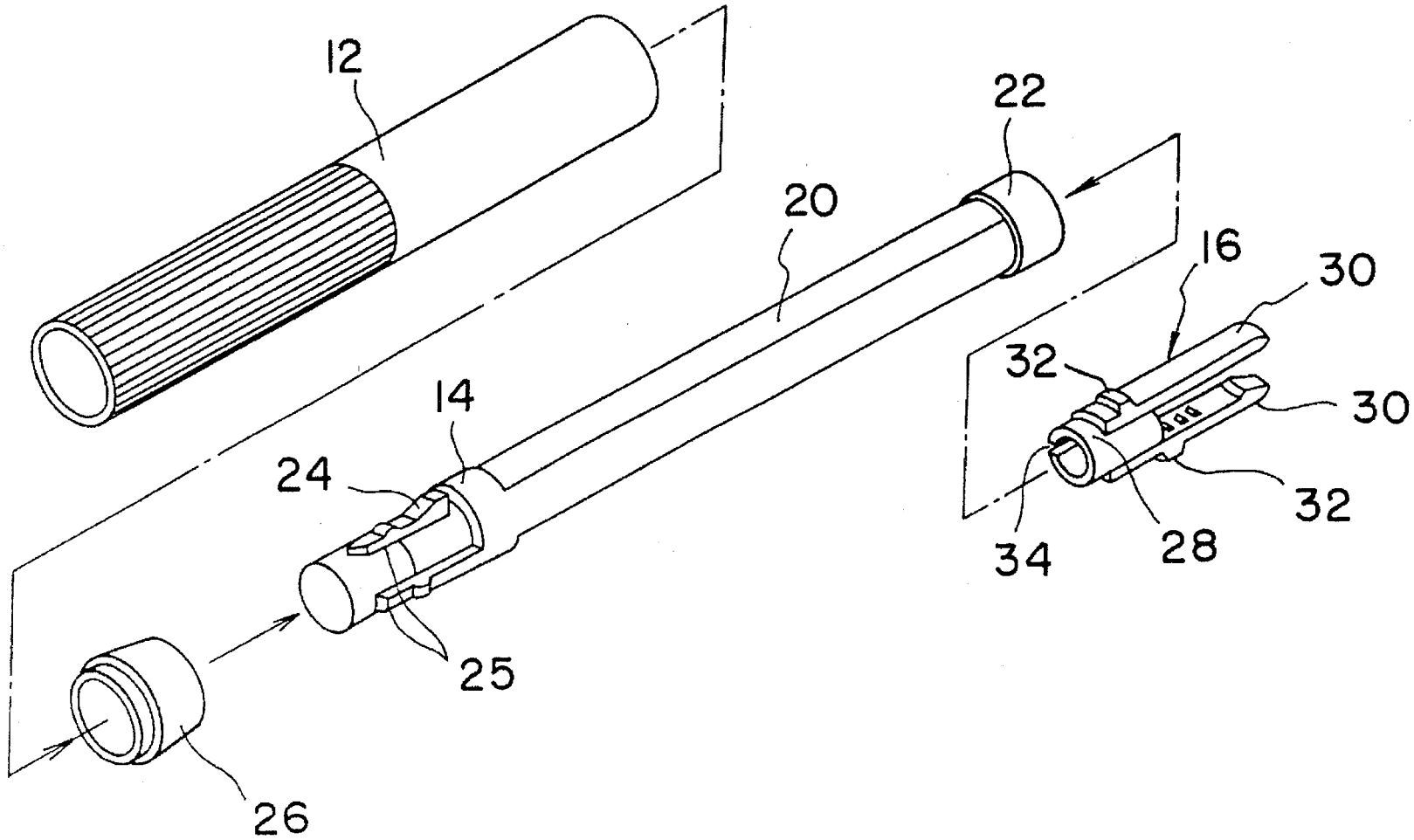
FIG. 3 is a perspective exploded view of the stick-shaped material propelling container of FIG. 1.

Guide sleeve 14 includes two guide grooves 20 formed on a portion thereof corresponding to spiral groove 18 extending in an axial direction of the container with circular step 22 formed at a head portion thereof, and rising rear stoppers 24. Metallic ring 26 for adding to the beauty of the stick-shaped material propelling device is attached to cover the head portion of guide sleeve 14. Inner step 27 of ring 26 contacts circular step 22 so that ring 26 can be secured to guide sleeve 14. Ring 26 is not necessarily independent from guide sleeve 14, but may be an integral part of circular step 22. Further ring 26 is not restricted to a metallic ring, but may be made of plastic. Keys 25 (FIG. 3) to engage receiver 2 placed in outer sleeve 1 are formed on the rear of rear stoppers 24 of guide sleeve 14. The rear end of lead storage tank 4 engages the end of receiver 2 opposite the end of receiving keys 25 (FIG. 3). Key grooves 3 to engage keys 25 are formed on the inside of receiver 2 to prevent guide sleeve 14 from turning relative to receiver 2.

Rear stoppers 24 are brought into contact with a rear end surface of tubular body 12, and ring 26 is brought into contact with a front end surface of tubular body 12. Therefore guide sleeve 14 is inserted into tubular body 12 so that guide sleeve 14 is not movable in an axial direction, but is turnable relative to tubular body 12.

As shown in FIG. 2, holder 16 includes tubular holder body 28, and two clamping pieces 30 for holding stick-shaped material 36. Projections 32 to engage spiral groove 18 through guide grooves 20 are formed on the outside of respective clamping pieces 30. The inner distance between two clamping pieces 30 is nearly equal to the outer diameter of holder body 28. Clamping pieces 30 slidably engage guide grooves 20. Further, holder body 28 has slit 34 extending in the axial direction from the front end to the rear end of holder body 28 though the side wall portion where there are no projections 32.

Holder 16 can be formed by a mold using a pin located at a position corresponding to slit 34. Holder 16 can be manufactured simply in one forming operation.

Assembly of stick-shaped material propelling container 10 is explained as follows with reference to FIG. 3. First, holder 16 is inserted into guide sleeve 14 from the head end of guide sleeve 14. Since holder 16 has slit 34, holder 16 can easily bend inward over the entire length so that projections 32 can pass through the head end portion of guide sleeve 14 and projections 32 can easily engage guide sleeve 20. The width w of slit 34 (FIG. 2(B)) is preferably at least an amount that equals the total heights of projections 32 in order to secure the insertion of projections 32 into guide groove 20. Ring 26 then goes over guide sleeve 14 from behind. Rising rear stoppers 24 pass through ring 26 by bending inward. In turn, holder 16 with projections 32 passes through ring 26 by bending inward over the entire length because of slit 34. In such a manner, ring 26 is moved until inner step 27 contacts circular step 22. After holder 16 and ring 26 are attached to guide sleeve 14, tubular body 12 is mounted on sleeve 14 from behind. Rear stoppers 24 bend inward when they pass through tubular body 12 and then return to their normal position to fix guide sleeve 14 to tubular body 12 when they get beyond the rear of tubular body 12.

As above-mentioned, upon mounting holder 16 in guide sleeve 14, and attaching ring 26 to guide sleeve 14, slit 34 of holder 34 enables projections 32 to bend inward, allowing easy assembly of the stick-shaped material propelling container.

When using stick-shaped material propelling container 10 assembled as previous described, guide sleeve 14 is turned relative to tubular sleeve 12, or outer sleeve 1 is turned relative to tubular body 12. Since outer sleeve 1 is prevented from turning relative to guide sleeve 14 via receiver 2, guide sleeve 14 turns relative to tubular body 12, while projections 32 travel along spiral groove 18 and holder 16 moves in an axial direction guided by guide grooves 20. Therefore stick-shaped material or eraser 36 held by clamping pieces 30 is extended from or retracted into the head end of stick-shaped material propelling container 10 according to the direction guide sleeve 14 is turned.

In the present embodiment, groove 23 communicating with guide groove 20 can be provided on the inside of the head portion of guide sleeve 14. Therefore a remnant of stick-shaped material 36 can be easily removed from stick-shaped material propelling container 10, because clamping pieces 30 project from stick-shaped material propelling container 10 by passing through groove 23 when holder 16 is moved toward the head of tubular body 12 to the maximum.

In use, after a stick-shaped material 36 is fully extended from stick-shaped material propelling container 10, if a user happens to forcibly continue to turn tubular body 12 to try to further extend stick-shaped material 36 from stick-shaped material propelling container or conversely, after stick-shaped material 36 is fully retracted into stick-shaped material propelling container 10, a user continues to forcibly turn tubular body 12 relative to guide sleeve 14 to try to further retract stick-shaped material 36 into stick-shaped material propelling container 10. In such a cases, slit 34 enables holder 16 to bend inward, and holder 16 can rotate over the ridge between spiral grooves 18. This allows holder 16 to freely turn at either end portion of spiral groove 18 preventing projections 32 of holder 16 or spiral groove 18 from being broken.

Figure 4A:
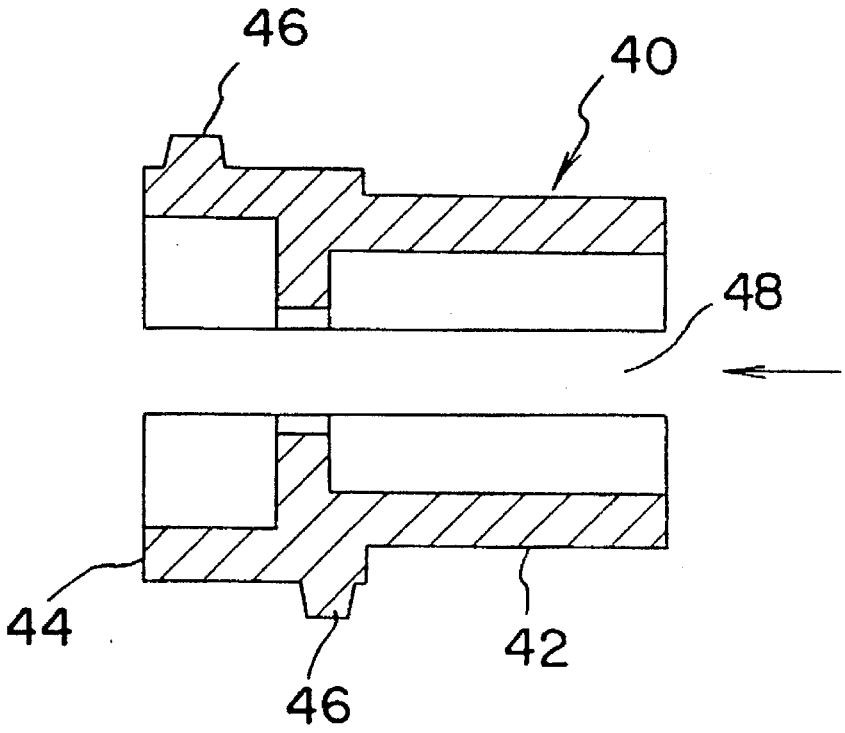
FIGS. 4(A) and (B) show other example of a holder according to the present invention, FIG. 4(A) being a vertical section of the holder and FIG. 4(B) being a view taken in the direction of the arrow shown in FIG. 4(A).
Figure 4B:
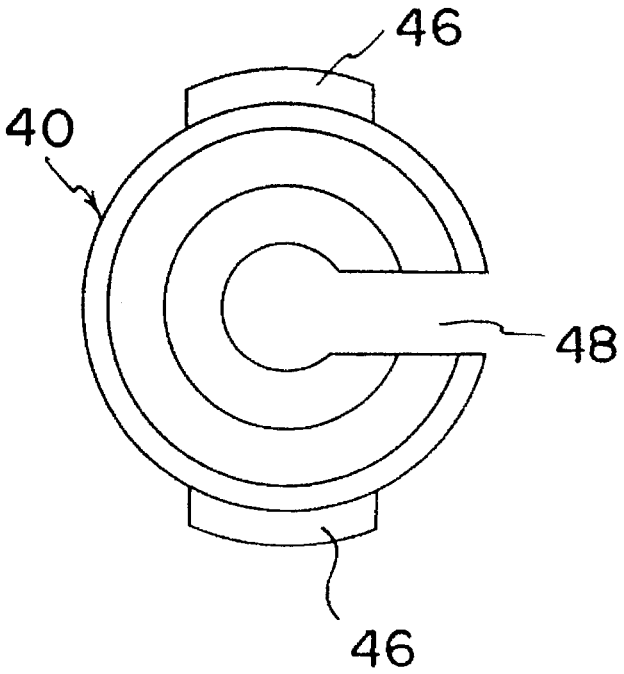
Figure 5:
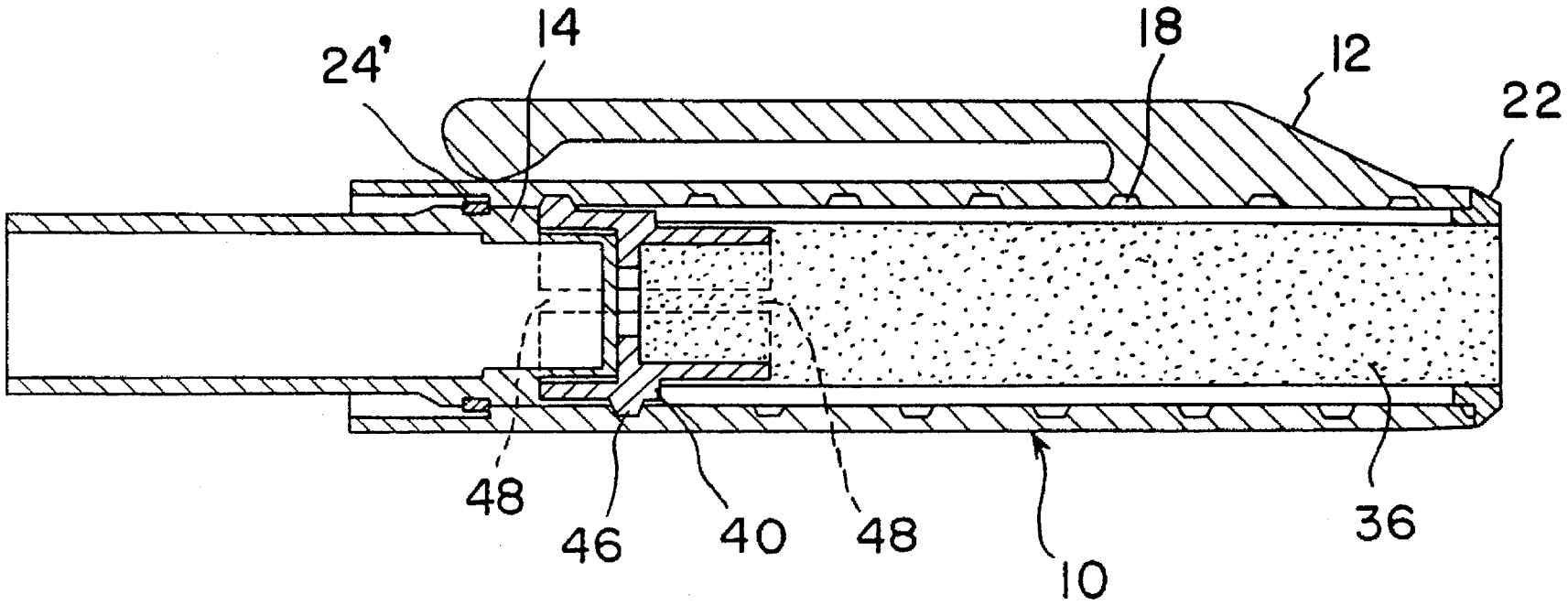
FIG. 5 is a vertical section of the stick-shaped material propelling container with the holder shown in FIG. 4 being mounted.

FIGS. 4(A) and (B) show an another embodiment of holder. FIG. 4(A) is a vertical section of holder, and FIG. 4(B) is a view taken in the direction of the arrow shown in FIG. 4(A). FIG. 5 is a vertical section of stick-shaped material propelling container in which the holder of FIG. 4 is mounted.

Holder 40 is inserted into guide sleeve 14 in the same manner as the first embodiment, and guide sleeve 14 is inserted into tubular body 12. Guide sleeve 14 is inserted into tubular body 12 and is be not movable in an axial direction, but is rotatable relative to tubular body 12 by means of forward circular step 22 provided and C ring 24' provided rearward of guide sleeve 14.

Holder 40 of this embodiment comprises stick-shaped material clamping sleeve 42 and guide groove engaging sleeve 44. The outer diameter of guide groove engaging sleeve 44 is larger than that of stick-shaped material clamping sleeve 42. Guide groove engaging sleeve 44 slidably engages guide groove 20. Projections 46 provided on the periphery of guide groove engaging sleeve 44 engage spiral grooves 18 through guide groove 20.

Slit 48 which extends in the axial direction is provided in a side wall portion of holder 40 where there are no projections 46.

In case of such a holder 40, since guide groove engaging sleeve 44 has a tubular shape, it could not be bent inward without slit 48, therefore it would be impossible to insert projections 46 from the top of guide sleeve 14 into guide groove 20 without slit 48. However, in the present embodiment, since slit 48 is provided, projections 46 can be easily inserted into guide groove 20.

As above-mentioned, according to the present embodiment, slit 48 is provided in holder 40, which enables holder 40 to easily bend inward over the axial length of the holder, insertion of holder 40 into guide sleeve 20 and attachment of ring 24' to guide sleeve 14 can be easily done.

and even if guide sleeve 14 is forcibly turned, spiral groove 18 or projections 46 are prevented from being broken.

While the principles of the invention have been described above in connection with specific embodiments, and particular modifications thereof, it is to be clearly understand that this description is given only by way of example and not as a limitation on the scope of invention.

What is claimed is:

1. A writing instrument comprising;

an outer sleeve;

a storage tank position inside said outer sleeve and having an open end;

receiving means having a forward facing socket, a rearward facing socket, a passageway communicating between said forward facing socket and said rearward facing socket, and at least one key groove;

said receiving means positioned inside said outer sleeve and engaging said open end of said storage tank at said forward facing socket thereof, whereby said passageway of said receiving means communicates with said open end of said storage tank; and a stick-shaped material propelling container mounted in a rear portion of said outer sleeve, said stick-shaped material propelling container comprising:

a guide sleeve having lengthwise guide grooves and a closed cylindrical end including at least one key;

a stick-shaped material holder movably inserted in said guide sleeve, said stick-shaped material holder having projections engaging said lengthwise guide grooves;

a tubular body having a spiral groove on an inside surface thereof and fitted over said guide sleeve with said projections on said stick-shaped material holder engaging said spiral groove; and retaining means for retaining said guide sleeve in said tubular body and preventing movement of said guide sleeve in an axial direction relative to said tubular body;

said stick-shaped material propelling container being inserted inside said outer sleeve with a front portion of the tubular body surrounded by the outer sleeve and with said cylindrical closed end of said guide sleeve engaging said rearward facing socket on said receiving means thereby causing said passageway, communicating with said open end of said storage tank, to be closed, with said at least one key on said closed cylindrical end of said guide sleeve engaging said at least one key groove in said receiving means so that said guide sleeve cannot rotate relative to said outer sleeve, but can rotate relative to said tubular body;

whereby said stick-shaped material is selectively extended or retracted by rotation of said guide sleeve relative to said tubular body.

2. A writing instrument according to claim 1 wherein said retaining means comprises at least one stop on said closed cylindrical end of said guide sleeve, and a retaining ring at an end of said guide sleeve opposite said cylindrical end of said guide sleeve.

3. A writing instrument according to claim 1 or 2, wherein said receiving means tightly fits inside said outer sleeve while being allowed to slide relative to said outer sleeve, so that when said stick-shaped material propelling container is removed from said outer sleeve and said receiving means in order to allow loading leads into said storage tank from the rear end of said outer sleeve, said leads can securely enter said storage tank without dropping into a space between said receiving means and said outer sleeve when said leads are put into said outer sleeve from the rear end of said outer sleeve.

* * * * *